US012209800B2

(12) United States Patent
Bihr et al.

(10) Patent No.: US 12,209,800 B2
(45) Date of Patent: Jan. 28, 2025

(54) DOMESTIC APPLIANCE HAVING A TRANSCEIVER UNIT

(71) Applicant: BSH Hausgeraete GmbH, Munich (DE)

(72) Inventors: Daniel Bihr, Kirchheim am Ries (DE); Christopher Rodney, Villenbach (DE)

(73) Assignee: BSH Hausgeraete GmbH, Munich (DE)

( * ) Notice: Subject to any disclaimer, the term of this patent is extended or adjusted under 35 U.S.C. 154(b) by 325 days.

(21) Appl. No.: 17/771,608

(22) PCT Filed: Oct. 19, 2020

(86) PCT No.: PCT/EP2020/079310
§ 371 (c)(1),
(2) Date: Apr. 25, 2022

(87) PCT Pub. No.: WO2021/078665
PCT Pub. Date: Apr. 29, 2021

(65) Prior Publication Data

US 2022/0373252 A1 Nov. 24, 2022

(30) Foreign Application Priority Data

Oct. 25, 2019 (DE) ..... 10 2019 216 441.2

(51) Int. Cl.
*F25D 29/00* (2006.01)
*F25D 23/02* (2006.01)

(52) U.S. Cl.
CPC ..... *F25D 29/005* (2013.01); *F25D 23/028* (2013.01)

(58) Field of Classification Search
CPC ..... F25D 29/005; F25D 23/00; F25D 23/02; F25D 23/028; F25D 25/025; F25D 2400/36; F25D 2700/08; F25D 11/00
See application file for complete search history.

(56) References Cited

U.S. PATENT DOCUMENTS 7,680,691 B2 * 3/2010 Kimball ..... G06Q 10/087 340/572.1
7,798,865 B2 * 9/2010 McCoy ..... H05K 5/0017 439/676

(Continued)

FOREIGN PATENT DOCUMENTS

DE 102009046576 A1 5/2011
DE 102013216763 A1 2/2015

(Continued)

*Primary Examiner* — Marc E Norman
(74) *Attorney, Agent, or Firm* — Laurence A. Greenberg; Werner H. Stemer; Ralph E. Locher

(57) ABSTRACT

A domestic appliance has a housing, a transceiver unit and an electrically non-conductive covering. The housing delimits an interior accessible via a housing opening and has a frame which edges the housing opening. The transceiver unit contains an antenna for wirelessly receiving and transmitting signals. The domestic appliance has a door leaf, which is mounted pivotably relative to the housing and is provided to open and close the interior, or a drawer, which can be pulled partially out of the interior and has a front panel which closes the interior when in the pushed-in state. The housing, the door leaf or the front panel of the drawer has a cavity which is accessible via an opening in the housing, in the door leaf or in the front panel and inside of which the transceiver unit with the entire antenna is arranged. The electrically non-conductive covering covers the opening completely.

11 Claims, 8 Drawing Sheets

(56) References Cited

U.S. PATENT DOCUMENTS

| | | | | |
|---|---|---|---|---|
| 7,843,697 | B2 * | 11/2010 | McCoy | F25D 23/12 361/728 |
| 7,870,753 | B2 * | 1/2011 | Marcy, V | G06F 1/166 62/331 |
| 8,042,346 | B2 | 10/2011 | Oh et al. | |
| 9,541,325 | B2 * | 1/2017 | Sato | F25D 29/00 |
| 10,907,884 | B1 * | 2/2021 | Scorsim | F25D 23/028 |
| 2014/0137586 | A1 * | 5/2014 | Mukherjee | F25D 29/005 62/127 |
| 2014/0174489 | A1 * | 6/2014 | Cottrell | A47L 15/4287 134/56 D |
| 2016/0123055 | A1 * | 5/2016 | Ueyama | F25D 23/028 312/405 |
| 2021/0254884 | A1 * | 8/2021 | Hong | F25D 29/005 |

FOREIGN PATENT DOCUMENTS

| | | | |
|---|---|---|---|
| EP | 2835604 | A1 | 2/2015 |
| EP | 3032202 | A1 | 6/2016 |

* cited by examiner

DOMESTIC APPLIANCE HAVING A TRANSCEIVER UNIT

FIELD AND BACKGROUND OF THE INVENTION

The invention relates to a household appliance, in particular a household refrigeration appliance that comprises a transceiver unit.

EP 3 032 202 A1 discloses a household refrigeration appliance, which comprises a thermally insulated housing having an interior space that can be cooled and is provided for storing food, a door leaf that is pivotally mounted on the housing by hinges and is provided so as to open and close the interior space that can be cooled, and a wireless adaptor that is configured so as to transmit and receive radio waves. The upper, outward facing surface of the housing is manufactured from a steel sheet and thus shields radio waves. The household refrigeration appliance therefore comprises for the upper hinge a non-conductive cover which is located above the upper surface of the housing and the wireless adaptor together with its antenna is fastened in said non-conductive cover.

U.S. Pat. No. 8,042,346 B2 discloses a household refrigeration appliance, which comprises a thermally insulated housing having an interior space that can be cooled and is provided so as to store food, a door leaf that is pivotally mounted on the housing by hinges so as to open and close the interior space that can be cooled, a display apparatus and a wireless receiver module that is releasably fastened to the housing. The receiver module is configured so as to receive radio waves that comprise everyday information so that the display apparatus displays the information. The household refrigeration appliance comprises an antenna that is connected at one of its ends to the receiver module and its other end is guided through the upper hinge and as far as to above the housing in order to receive the radio waves.

SUMMARY OF THE INVENTION

The object of the present invention is to propose an improved household appliance that has a wireless transceiver unit.

The object of the invention is achieved by a household appliance, comprising

- a housing that delimits an interior space that is accessible via a housing opening and has a frame that borders the housing opening,
- a door leaf that is mounted so as to be able to pivot relative to the housing and is provided so as to open and close the interior space, or a drawer that can be pulled at least in part out of the interior space and that has a front plate that in the pushed-in state closes the interior space,
- at least one transceiver unit that comprises an antenna so as to receive and transmit signals in a wireless manner, and
- at least one electrically non-conductive cover, wherein the housing, the door leaf or the front plate of the drawer has a hollow space that is accessible via an opening in the housing, in the door leaf or in the front plate and the transceiver unit together with its complete antenna is arranged within said hollow space and the electrically non-conductive cover completely covers the opening.

The household appliance comprises accordingly the housing having the frame and the housing opening that is bordered by the frame. The housing delimits the interior space that is accessible via the housing opening.

The door leaf is pivotably mounted relative to the housing for example by hinges and is provided so as to open and close the interior space or the housing opening.

The drawer comprises the front plate. It can be pulled at least in part out of the interior space and by means of its front plate closes the interior space or the housing opening in the closed state.

The household appliance is for example an oven having an interior space that can be heated by a heating apparatus of the oven and is provided so as to heat food.

The household appliance is for example a dishwasher having an interior space into which dirty dishware can be placed in order to be washed by the dishwasher.

In accordance with a preferred embodiment of the household appliance in accordance with the invention, this household appliance is a household refrigeration appliance with the result that the housing is a thermally insulated housing, the door leaf is thermally insulated and the front plate of the drawer is thermally insulated. The interior space of the household refrigeration appliance is an interior space that can be cooled and is provided so as to store food and the household refrigeration appliance comprises a refrigeration apparatus that is provided so as to cool the interior space that can be cooled.

The interior space that can be cooled is cooled by means of the refrigeration apparatus. This is preferably designed as a refrigerant circuit that is known in principle to the person skilled in the art and is preferably configured in such a manner that it cools the interior space, which can be cooled, at least approximately to a predetermined temperature. The interior space that can be cooled is provided so as to store food.

The household refrigeration appliance in accordance with the invention can be a household refrigeration appliance, for example. In this case, the interior space that can be cooled is cooled to a temperature greater than 0° C.

It is preferred that the door leaf of the household refrigeration appliance in accordance with the invention comprises on its side that faces the interior space that can be cooled a circumferential door seal with which the closed door leaf lies against the frame of the thermally insulated housing with the result that the frame and the side of the closed door leaf that faces the interior space that can be cooled form a gap. The door seal is preferably a magnetic seal familiar to the person skilled in the art.

It is preferred that the front plate of the drawer of the household refrigeration appliance in accordance with the invention comprises on its side that faces the interior space that can be cooled a circumferential seal with which the side of the front plate of the closed drawer that faces the interior space that can be cooled lies against the frame of the thermally insulated housing with the result that the frame and the side of the front plate of the closed drawer that faces the interior space that can be cooled form a gap. The seal is likewise preferably a magnetic seal.

The household appliance can comprise precisely one interior space or multiple interior spaces that are arranged for example adjacent to one another or one above the other.

The housing comprises in particular two side walls that are arranged adjacent to one another, and a horizontally running wall. The horizontally running wall forms in particular the top wall of the interior space. The side walls and the horizontally running wall have in particular in each case inner sides that face the interior space and outward facing outer sides. It is preferred that the horizontally running wall forms the uppermost wall of the housing and comprises a side that faces the interior space and an outward facing outer side.

The door leaf comprises in particular an inner side that faces the interior space, and an outer side that is remote from the interior space that can be cooled.

The front plate of the drawer comprises in particular an outer side that is remote from the interior space that can be cooled.

The household appliance comprises the door leaf or the drawer. It is also possible to provide that the household appliance comprises multiple door leaves or multiple drawers.

In particular, it is possible to provide that the household appliance comprises one door leaf and one drawer. In this case, it is preferably provided that the housing has two interior spaces that are arranged one above the other and are accessible via corresponding housing openings. In this case, the interior space forms for example an upper interior space above which a lower interior space is arranged, which are separated by a horizontally running middle wall of the housing. The middle horizontally running wall comprises a side that faces the lower interior space, and a side that faces the upper interior space.

In particular, it is possible to provide that the household appliance or the household refrigeration appliance has multiple drawers but no door leaf. The drawers are preferably arranged one above the other with the result that the household appliance in this case has preferably multiple interior spaces that are arranged one above the other and are accessible via corresponding housing openings.

The horizontally running wall of the housing is for example this middle horizontally running wall or an upper horizontally running wall that comprises an outward facing outer side outward and a side that faces the upper interior space. It is preferred in this case that the door leaf is provided so close and to open the upper interior space or its housing opening, and the drawer is arranged in the lower interior space. If the household appliance is a household refrigeration appliance, then in this case it is preferably a combined fridge-freezer, wherein in particular the lower interior space that can be cooled is a freezer compartment and the drawer can be pulled at least in part out of said freezer compartment, and the upper interior space that can be cooled is a refrigerator compartment that can be closed by the door leaf.

Moreover, the household appliance comprises the at least one transceiver unit that comprises an antenna so as to receive and transmit signals in a wireless manner. The transceiver unit comprises for example a circuit board on which for example electrical and/or electronic components of the transceiver unit and the antenna are arranged.

The transceiver unit is designed for example as an assembly and is set up so as to receive or transmit signals in a wireless manner.

The transceiver unit is preferably a Wi-Fi transceiver unit. The Wi-Fi transceiver unit is set up in particular so as to communicate with further Wi-Fi devices. A further Wi-Fi device is for example a Wi-Fi router that is connected to the internet. The transceiver unit can also be an RFID transceiver unit. The transceiver unit can also be an RFID the transceiver unit.

The transceiver unit is arranged in the hollow space of the household appliance. The hollow space is accessible via the opening. The opening is in turn closed by the electrically non-conductive cover. By virtue of the fact that the cover is manufactured from an electrically non-conductive material, for example a plastic, the signals that are transmitted or received in a wireless manner by the transceiver unit can pass through the cover. This renders possible communication with the transceiver unit.

If the housing comprises the hollow space, then the hollow space is preferably arranged in the horizontally running wall of the housing. It is preferred that the horizontally running wall forms the top wall of the interior space and comprises in particular a side that faces the interior space and an outer side that faces outward.

In accordance with a preferred variant of the household appliance, its housing, its door leaf and its front plate each have an outer skin that faces outward and is manufactured from metal or comprises metal. In particular, the outer skin extends as far as over the frame of the housing and the end faces of the door leaf and the front plate of the drawer. In particular, the outer wall in question comprises the opening. As a result, large components of the housing, of the drawer and of the door leaf shield the transceiver unit. Since however the cover is manufactured from the electrically non-conductive material, it is still possible for the transceiver unit to transmit and to receive information in a wireless manner although the complete antenna is also arranged in the hollow space, in other words within the household appliance.

The hollow space is preferably designed in the shape of a pocket and the transceiver unit is pushed into the pocket-shaped hollow space. This renders it possible to assemble the household appliance in a relatively simple manner.

The transceiver unit can preferably be attached to the cover, and consequently forms a common assembly in particular with the cover. In conjunction with the pocket-shaped hollow space, it is consequently possible to push the transceiver unit together with the cover into the hollow space and to subsequently attach it. It is possible to realize this attachment for example by virtue of the fact that the cover together with the transceiver unit is screwed in the region of the opening to the housing, to the door leaf or to the front plate of the drawer. As a consequence, the transceiver unit can be replaced when necessary.

In accordance with one variant of the household appliance, this can have an electronic control apparatus that is arranged in the hollow space and is provided so as to activate at least one component of the household appliance. In other words, it is possible to provide that only the transceiver unit is arranged alone in the hollow space or is arranged together with the electronic control apparatus. It is preferred that the transceiver unit and the electronic control apparatus are attached to the cover and consequently form in particular a common assembly.

The electronic control apparatus is for example, in the case of the household refrigeration appliance, set up so as to activate the cooling apparatus as a component or in the case of the oven to activate the heating apparatus as a component.

The component of the household appliance can be for example a camera which is set up for example to process images of the interior space.

In particular, it is possible to provide that the assembly, which comprises only the transceiver unit or also the transceiver unit and the electronic control apparatus, is positioned in the pocket-shaped hollow space. If the assembly comprises the transceiver unit and the electronic control apparatus, then the transceiver unit can be placed on the electronic control apparatus.

The pocket-shaped hollow space is provided in particular in the front region with a plastic screen as an electrically non-conductive cover. The housing of the household refrigeration appliance or of the household appliance can be made from plastic, metal or cardboard (also lined with metal). The connection can be provided for example via a B2B interface, spring contacts or edge card connectors.

It is also possible to provide that the assembly, which comprises only the transceiver unit or also the transceiver unit and the electronic control apparatus, is placed by means of a carrier frame in the region of the hollow space or of the pocket-shaped hollow space.

This optionally renders it possible to integrate a local Ethernet switch should the device function be expanded by imaging unit. The carrier frame itself is made for example from plastic and is mechanically fixed to the cover which in turn is attached to the hollow space or to the pocket-shaped hollow space. Alternatively, the carrier frame can also be fixed directly to the hollow space or to the pocket-shaped hollow space.

If the hollow space or the transceiver unit is arranged in the housing, then in accordance with a preferred embodiment of the household appliance the opening of the hollow space is arranged in the frame of the housing, in particular in an end face of the horizontally running wall, said end face forming in part the frame of the housing. The electrically non-conductive cover completely covers the opening and is consequently part of the frame. It is preferred that the horizontally running wall forms the top wall of the interior space and comprises in particular a side that faces the interior space and an outer side that faces outward. Consequently, the cover of the hollow space faces forward and renders it possible for the transceiver unit to receive and transmit signals in a relatively effective manner through the cover.

If the hollow space or the transceiver unit is arranged in the door leaf, then in accordance with a preferred embodiment of the household appliance the opening of the hollow space is arranged in an end face, in particular in an upward facing upper end face of the door leaf, and the electrically non-conductive cover completely covers the opening and is part of this end face of the door leaf. This arrangement of the opening also renders it possible for the transceiver unit to receive and transmit signals in a relatively effective manner through the cover.

If the hollow space or the transceiver unit is arranged in the drawer or its front plate, then in accordance with a preferred embodiment of the household appliance the opening of the hollow space is arranged in an end face, in particular in an upward facing upper end face of the front plate of the drawer, and the electrically non-conductive cover completely covers the opening and is part of this end face of the door leaf. This arrangement of the opening also renders it possible for the transceiver unit to receive and transmit information in a relatively effective manner through the cover.

If the housing, in particular its horizontally running wall, comprises the hollow space, and if the opening of the hollow space is arranged on the frame, then in accordance with a preferred embodiment of the household appliance it is provided that the closed door leaf overlaps the frame of the housing at least in the region of the opening and the inner side, which is facing the interior space, of the closed door leaf is spaced at least in the region of the opening from the frame in such a manner that the inner side, which faces the interior space, of the closed door leaf forms a gap at least in the region of the opening with the result that signals that are transmitted by the antenna of the transceiver unit or are received by the antenna are able to pass through the gap and through the electrically non-conductive cover. The gap in the case of the household appliance that is designed as a household refrigeration appliance is formed in particular by the door seal. By virtue of the fact that in accordance with this variant of the household appliance, the closed door leaf overlaps the frame at least in the region of the opening, the cover is covered by the closed door leaf. On account of the gap, it is possible that the transceiver unit can receive and transmit the signals in a relatively effective manner even if the outer skins should be made from metal or comprise metal.

If the door leaf comprises the hollow space or the transceiver apparatus and if the opening is arranged in the upward facing end face of the door leaf, then it is provided in accordance with a preferred embodiment of the household appliance that a component of the household appliance overlaps the upward facing upper end face of the closed door leaf and is spaced from this end face of the closed door leaf in such a manner that the upper end face of the closed door leaf forms a gap with this component of the household refrigeration appliance with the result that signals that are transmitted by the antenna of the transceiver unit or are received by the antenna are able to pass through the gap and through the electrically non-conductive cover. On account of the gap, it is possible that the transceiver unit can receive and transmit the information in a relatively effective manner even if the outer skins should be made from metal or comprise metal.

If the front plate of the drawer comprises the hollow space or the transceiver apparatus and if the opening is arranged in the upward facing upper end face of the front plate of the drawer, then in accordance with a preferred embodiment of the household appliance it is provided that a component of the household appliance overlaps the upper end face of the front plate of the closed drawer and is spaced from this end face of the front plate of the closed drawer in such a manner that the upper end face of the front plate of the closed drawer forms a gap with this component of the household refrigeration appliance with the result that signals that are transmitted by the antenna of the transceiver unit or are received by the antenna are able to pass through the gap and through the electrically non-conductive cover. On account of the gap, it is possible that the transceiver unit can receive and transmit the information in a relatively effective manner even if the outer skins should be made from metal or comprise metal.

It is preferred that the component of the household appliance is a horizontally running wall of the housing with the result that the housing with its horizontally running wall overlaps the upper end face of the closed door leaf or of the front plate of the closed drawer.

If the door leaf comprises the hollow space or the transceiver apparatus and if the opening is arranged in the upward facing end face of the door leaf, then the housing with its horizontally running wall preferably overlaps the upward facing upper end face of the closed door leaf and is spaced from the upper end face of the door leaf in such a manner that the upper end face of the closed door leaf forms a gap with the horizontally running wall of the housing with the result that signals that are transmitted by the antenna of the transceiver unit or are received by the antenna are able to pass through the gap and through the electrically non-conductive cover.

If the front plate of the drawer comprises the hollow space or the transceiver apparatus and if the opening is arranged in the upward facing upper end face of the front plate of the drawer, then in accordance with a preferred embodiment of the household appliance it is provided that in the closed state of the drawer the housing with its horizontally running wall overlaps the upper end face of the front plate of the closed drawer and is spaced from the upper end face of the front plate in such a manner that the upper end face of the front plate in the closed state of the drawer forms a gap with the horizontally running wall of the housing with the result that signals that are transmitted by the antenna of the transceiver unit or are received by the antenna are able to pass through the gap and through the electrically non-conductive cover.

The component of the household appliance can be a further closed door leaf that is arranged above the closed door leaf with the result that the downward facing lower end face of the further closed door leaf overlaps the upward facing upper end face of the closed door leaf, or the component of the household appliance can be a further closed drawer that is arranged above the closed drawer with the result that the downward facing lower end face of the front plate of the further close drawer overlaps the upward facing upper end face of the front plate of the closed drawer.

In accordance with one embodiment of the household appliance, the interior space is a lower interior space and the housing of the household appliance delimits an upper interior space that is arranged above the lower interior space. In the case of the household refrigeration appliance, this is preferably a combined fridge-freezer.

It is preferred that the drawer is allocated to the lower interior space and the door leaf is allocated to the upper interior space. The component of the household appliance is then the closed door leaf that is arranged above the closed drawer with the result that the downward facing lower end face of the closed door leaf overlaps the upward facing upper end face of the front plate of the closed drawer and consequently a gap is formed.

If the door leaf comprises the hollow space, then in accordance with one variant of the household appliance the opening is arranged in the outward facing outer side of the door leaf with the result that the electrically non-conductive cover is a part of the outer side of the door leaf. As a consequence, it is possible for the transceiver unit that is arranged in the door leaf to receive and transmit signals relatively effectively even if the outer skins should be made from metal or comprise metal.

If the front plate of the drawer comprises the hollow space, then in accordance with one variant of the household appliance the opening is arranged in the outward facing outer side of the front plate of the drawer with the result that the electrically non-conductive cover is a part of the outer side of the door leaf. As a consequence, it is possible for the transceiver unit to receive and transmit the signals in a relatively effective manner even if the outer skins should be made from metal or comprise metal.

If the housing comprises the hollow space, then in accordance with one variant of the household appliance the opening is arranged in the outward facing outer side of the housing with the result that the electrically non-conductive cover is a part of the outer side of the housing. As a consequence, it is possible for the transceiver unit that is arranged in the housing to receive and transmit the signals relatively effectively through the cover even if the outer skins should be made from metal or comprise metal.

In accordance with a preferred variant of the household appliance, this comprises a display apparatus that is arranged together with the transceiver unit in the hollow space. It is preferred that the transceiver unit and the display apparatus form a common assembly. In this case, the electrically non-conductive cover is preferably transparent, at least semi-transparent. The cover is made for example from glass. The display apparatus is arranged in the hollow space in such a manner that information content that is displayed by the display apparatus can be viewed through the at least semi-transparent, electrically non-conductive cover. As a consequence, it is possible for the transceiver unit that is arranged in the door leaf or in the front plate so as to receive and transmit the displayed information content relatively effectively through the at least semi-transparent cover even if the outer skins should be made from metal or comprise metal.

In particular, it is provided to place the transceiver unit that is designed for example as a module or an assembly in the door leaf. The transceiver unit can be realized as an independent unit or as part of an already existing electronic system. In the case of an independent transceiver unit, this is preferably installed in a carrier housing and is arranged in the door leaf in such a manner that at least on one side of the transceiver unit the transmission power is not influenced or is only slightly influenced.

Exemplary embodiments of the invention are illustrated in an exemplary manner in the attached schematic drawings. In the drawings:

Exemplary embodiments of the invention are illustrated in an exemplary manner in the attached schematic drawings.

DETAILED DESCRIPTION OF THE INVENTION

Figure 1:
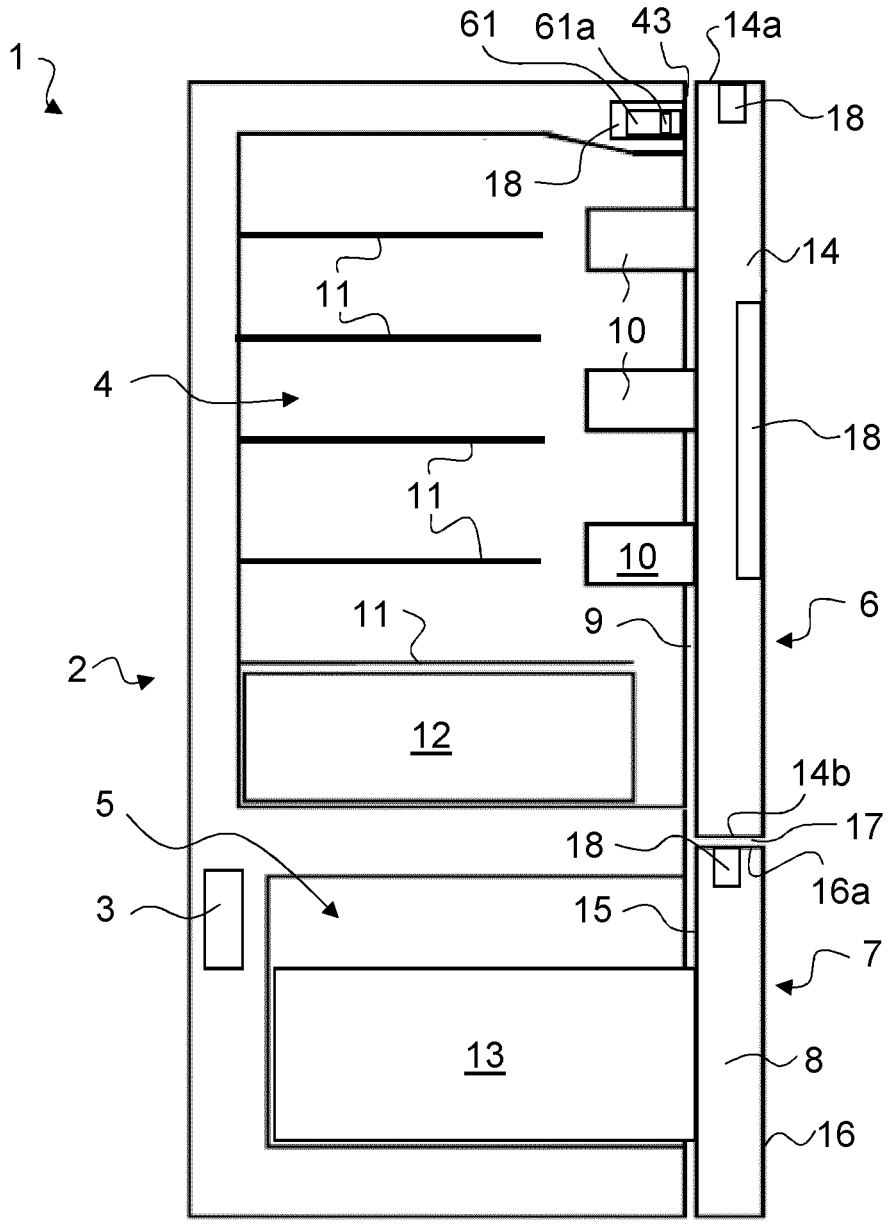
FIG. 1 shows a household refrigeration appliance having a housing, a door leaf, a drawer and a transceiver unit.
Figure 2:
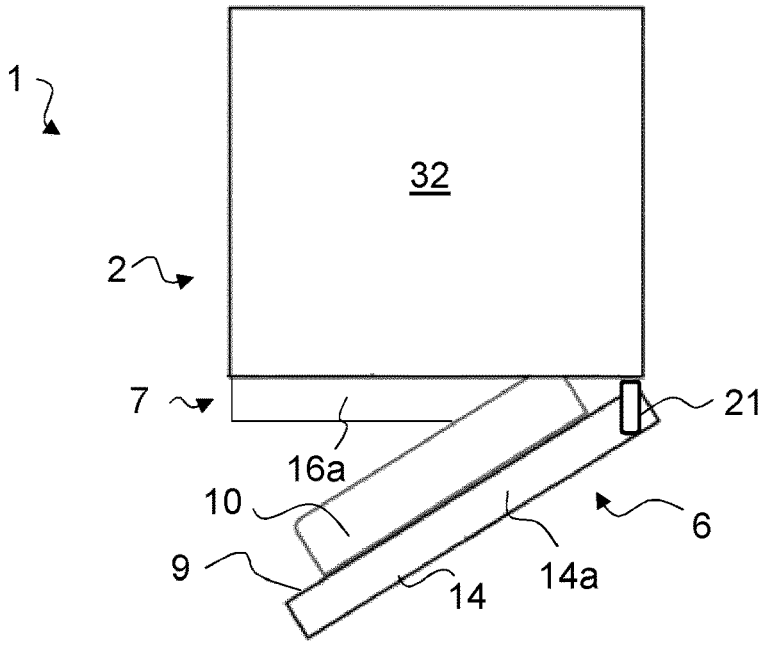
FIG. 2 shows a plan view of the household refrigeration appliance.

FIG. 1 illustrates a side view of the household refrigeration appliance 1 in a sectioned view as an example of a household appliance that comprises a housing 2 that delimits an interior space. FIG. 2 illustrates a plan view of the household refrigeration appliance 1.

Figure 3:
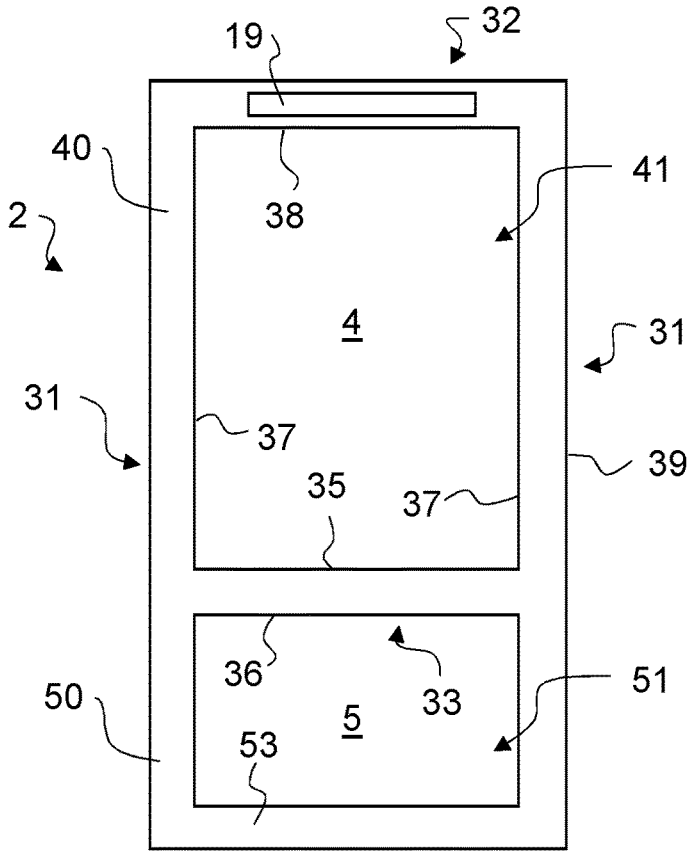
FIG. 3 shows a front view of the housing.

The housing 2 of the household refrigeration appliance 1 is thermally insulated. FIG. 3 illustrates a front view of the housing 2.

In the case of the present exemplary embodiment, the housing 2 delimits two interior spaces that are arranged one above the other and are cooled to predeterminable temperatures by means of a refrigeration apparatus 3 that is known in principle to the person skilled in the art and is designed in particular as a refrigerant circuit. The interior spaces are consequently interior spaces that can be cooled. In particular, the upper interior space that can be cooled is a refrigerator compartment 4 that is cooled by the refrigeration apparatus 3 to temperatures above 0° C. The lower interior space that can be cooled is in particular a freezer compartment 5 that is cooled by the refrigeration apparatus 3 to temperatures below 0° C.

The refrigerant circuit 3 comprises for example a compressor, a liquefier that is connected downstream of the compressor, a restrictor apparatus that is connected downstream of the liquefier and is embodied in particular as a restrictor tube or a capillary tube, and an evaporator that is arranged between the restrictor apparatus and the compressor.

The household refrigeration appliance 1 comprises in the case of the present exemplary embodiment an electronic controller that is configured so as to activate the refrigeration apparatus 3, in particular the compressor of the refrigerant circuit, in a manner known in general to the person skilled in the art, in such a manner that the refrigerator compartment 4 and the freezer compartment 5 have at least approximately predetermined or predeterminable setpoint temperatures. It is preferred that the electronic controller is configured in such a manner that it regulates the temperatures of the refrigerator compartment 4 and of the freezer compartment 5. In order where necessary to obtain the actual temperatures of the refrigerator compartment 4 and of the freezer compartment 5, the household refrigeration appliance 1 can have temperature sensors that are not illustrated in detail and are connected to the electronic controller.

The interior spaces that can be cooled are provided so as to store food (not illustrated).

The household refrigeration appliance 1 comprises in particular a door leaf 6 that in the closed state closes the refrigerator compartment 4, such as is illustrated in FIG. 1. In the open state of the door leaf 6, the refrigerator compartment 4 is accessible via a housing opening 41.

In the case of the present exemplary embodiment, the household refrigeration appliance 1 comprises a drawer 7 that comprises a front plate 8 and a container 13 that is open in the upward direction. The front plate 8 is attached to the container 13. Food can be stored in the container. In the closed state, the front plate 8 closes the freezer compartment 5 or a corresponding housing opening 51 of the freezer compartment 5. In the open state, the drawer 5 is pulled at least in part out of the freezer compartment 5.

The door leaf 6 and the front plate 8 are in particular thermally insulated. The door leaf 6 is for example mounted by means of hinges 21 relative to the housing 2.

The housing 2 comprises in particular two thermally insulated side walls 31, an upper horizontally running wall 32 and a middle horizontally running wall 33.

The middle horizontally running wall 33 separates the refrigerator compartment 4 from the freezer compartment 5 and comprises a side 35 that faces the refrigerator compartment 4 and a side 36 that faces the freezer compartment 5.

The side walls 31 comprise in each case an inner side 37, which faces the refrigerator compartment 4 and the freezer compartment 5, and in each case an outer side, and the upper horizontally running wall 32 comprises a side 38 that faces the refrigerator compartment 4 and an outer side. The outer sides of the upper horizontally running wall 32 and of the side walls 31 form the outer side 39 of the housing 2.

An upper part of the forward facing end faces of the side walls 31, and the forward facing end faces of the upper horizontally running wall 32 and the middle horizontally running wall 33 form an upper frame 40 that borders the housing opening 41 of the refrigerator compartment 4.

A lower part of the forward facing end faces of the side walls 31 and the forward facing end faces of the middle horizontally running wall 33 and of a base 53 of the freezer compartment 5 form a lower frame 50 that borders the housing opening 41 of the refrigerator compartment 4.

In the case of the present exemplary embodiment, the outer side 39 of the housing 2 is an outer skin that is made from metal or is an outer skin that comprises metal and extends in particular over the forward facing end faces of the side walls 31, of the upper horizontally running wall 32 and of the base 53. The end face of the middle horizontally running wall 33 is in particular made from metal or comprises metal with the result that the upper frame 40 and the lower frame 50 comprise metal or are made from metal.

In the case of the present exemplary embodiment, the door leaf 6 comprises an inner side 9, which faces the refrigerator compartment 4, multiple door racks 10 being arranged on said inner side so as to store food, and an outer side 14 that is remote from the refrigerator compartment 4. Furthermore, the door leaf 6 comprises an upper end face 14*a*, a lower end face 14*b* that faces the drawer 7 and lateral end faces that face sideward.

In the case of the present exemplary embodiment, the outer side 14 of the door leaf 6 is formed by an outer skin that comprises metal or is made from metal. In the case of the present exemplary embodiment, the outer skin extends over the upper end face 14*a*, the lower end face 14*b* and the lateral end faces of the door leaf 6.

In particular, multiple shelves 11 that are arranged one above the other so as to store food and a drawer 12 that can be pulled at least in part out of the refrigerator compartment 4 so as to store food are arranged within the interior space 4 which can be cooled.

Figure 4:
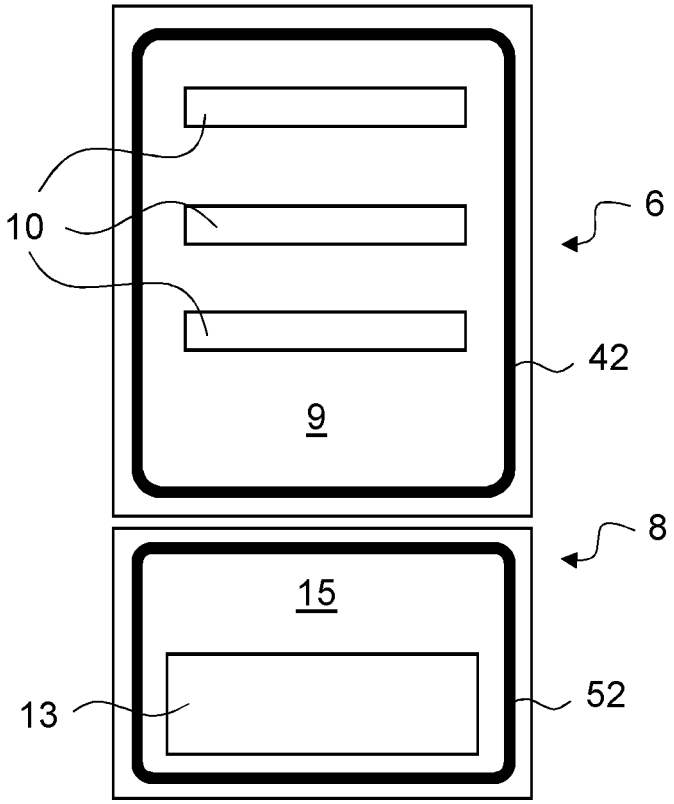
FIG. 4 shows front views of the door leaf and of a front plate of the drawer.

A circumferential door seal 42 that is illustrated in FIG. 4 is attached to the inner side 9 of the refrigerator compartment 4. Said circumferential door seal is designed in particular as a magnetic seal, such as is known in principle to the person skilled in the art. In the closed state, the door seal 42 of the door leaf 6 lies against the upper frame 40. As a consequence, a gap 43 is provided between the housing 2 or the upper frame 40 and the door leaf 6.

The front plate 8 comprises an inner side 15 that faces the freezer compartment 5 and in particular a circumferential seal 52 that is designed as a magnetic seal is attached to said inner side. In the closed state of the drawer 7, the seal 52 lies against the lower frame 50. As a consequence, a gap is provided between the housing 2 or the lower frame 50 and the door leaf 8.

The front plate 8 comprises an upper end face 16*a*, a lower end face and lateral end faces that face sideward. The lower end face 14*b* of the closed door leaf 6 and the upper end face 16*a* of the front plate 8 of the closed drawer 7 form a gap 17.

In the case of the present exemplary embodiment, the outer side 16 of the front plate 8 is formed by an outer skin that comprises metal or is made from metal. In the case of the present exemplary embodiment, the outer skin extends over the upper end face 16*a*, the lower end face and the lateral end faces of the door leaf 8.

Figure 5:
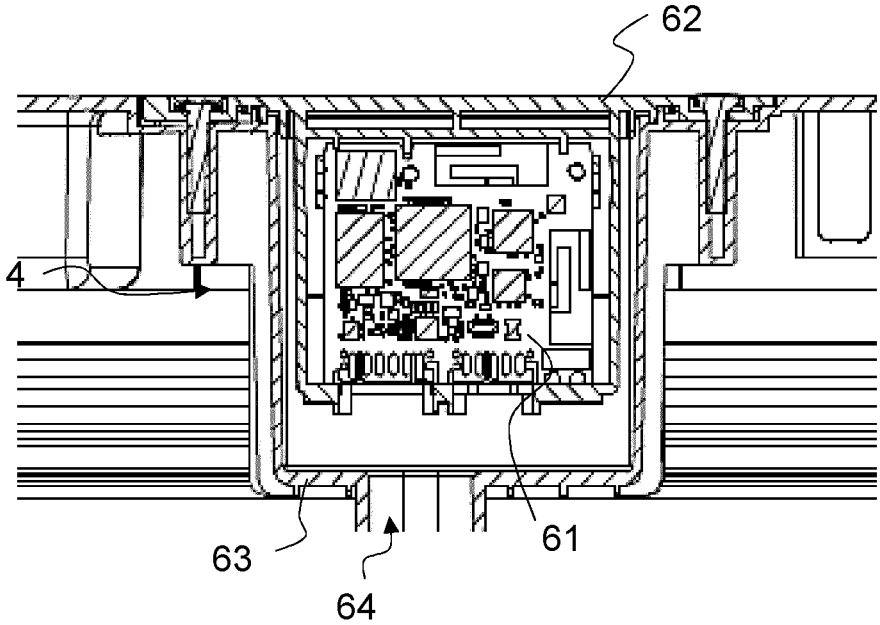
FIG. 5 shows an assembly that comprises the transceiver unit, FIG. 6, 7 show further assemblies that comprise the transceiver unit.

The household refrigeration appliance 1 comprises a transceiver unit 61 that is illustrated in FIG. 5 so as to receive and transmit signals in a wireless manner. The transceiver unit 61 is in particular a Wi-Fi transceiver unit 61. The transceiver unit 61 renders it possible for the household refrigeration appliance 1 to communicate for example with the internet in a wireless manner.

The household refrigeration appliance 1 comprises moreover a hollow space 18 and the transceiver unit 61 together with its antenna 61*a* is completely arranged in said hollow space. The hollow space 18 is arranged for example in the housing 2, in the door leaf 6 or in the front plate 8 of the drawer 7. In particular, the hollow space 18 is arranged in the upper running wall 32.

The hollow space 18 is accessible via an opening 19 in the housing 2, in the door leaf 6 or in the front plate 8. The hollow space 18 is designed in particular in a pocket-shaped manner.

If the hollow space 18 is arranged in the housing 2, in particular in its upper horizontally running wall 32, then the opening 19 is preferably arranged in one of the frames, preferably in the upper frame 40 or in the end face of the upper horizontally running wall 32.

If the hollow space 18 is arranged in the door leaf 6, then the opening 19 is preferably arranged in the upper end face 14*a* of the door leaf 6. The opening 19 can also be arranged in the lower end face 14*b* of the door leaf 6.

If the hollow space 18 is arranged in the front plate 8, then the opening 19 is preferably arranged in the upper end face 16*a* of the front plate 8.

The household refrigeration appliance 1 comprises an electrically non-conductive cover 62 that completely covers the opening 19.

In the embodiment of the transceiver unit 61 that is illustrated in FIG. 5, this is attached to the cover 62 and forms together with the cover 62 a common assembly 64. This assembly 64 comprises in particular a frame 63 to which is attached the cover 62 and the transceiver unit 61. In the case of the present exemplary embodiment, the assembly 63 that comprises the transceiver unit 61, the frame 63 and the cover 62 is pushed for assembly purposes into the hollow space 18 and then attached for example by screws to the housing 2, to the door leaf 6 or to the front plate 8.

Figure 6:
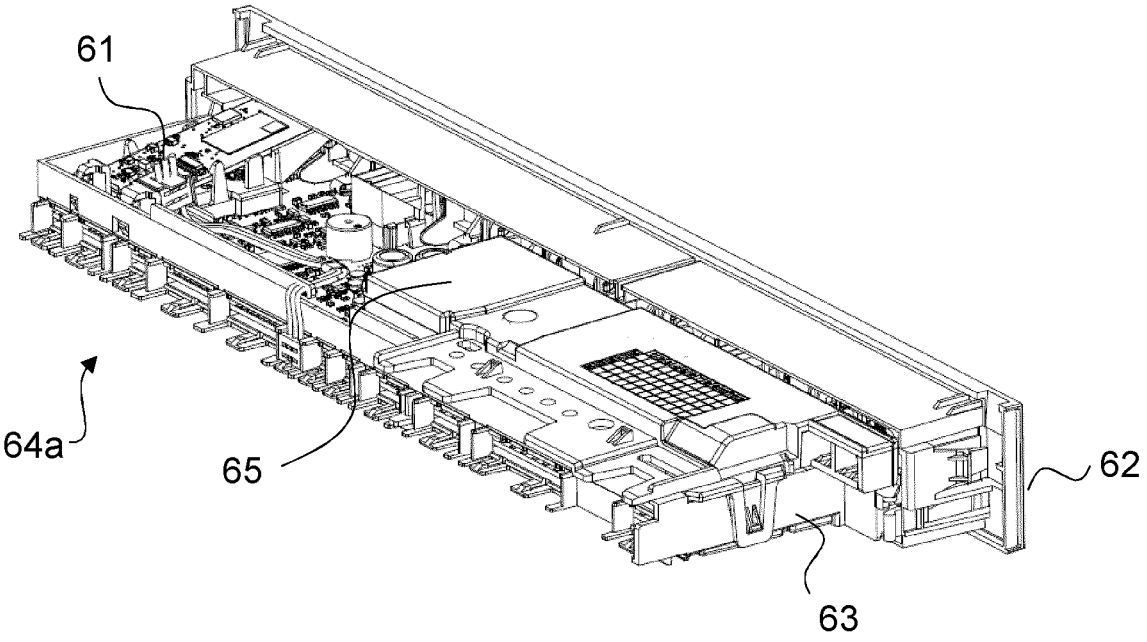

FIG. 6 illustrates a further assembly 64*a* that comprises the transceiver unit 61. The further assembly 64*a* essentially differs from the assembly 64 that is illustrated in FIG. 5 by virtue of the fact that the further assembly 64*a* comprises in addition to the transceiver unit 61 an electronic system 65. Consequently, in this case, in addition to the transceiver unit 61, the electronic system 65 is also arranged in the hollow space 18.

The electronic system 65 that is illustrated in FIG. 6 is for example the electronic control apparatus for the refrigeration apparatus 3 of the household refrigeration appliance. The electronic system 65 can also be provided so as to control a further component of the household refrigeration appliance 1, for example a camera (not further illustrated).

In the case of the embodiment that is illustrated in FIG. 6, the transceiver unit 61 is placed on the electronic system 65.

The further assembly 64*a* that is illustrated in FIG. 6 can comprise input/output means which are provided so as to set parameters that are provided for the electronic system 65, or which indicate for example states of the household refrigeration appliance 1. If the electronic system 65 is the electronic control apparatus for the refrigeration apparatus 3, then the parameters are for example the setpoint temperatures of the refrigerator compartment 4 and of the freezer compartment 5. Indicated states are for example the setpoint and actual temperatures of the refrigerator compartment 4 and of the freezer compartment 5. The input/output means are for example arranged on the cover 62.

Figure 7:
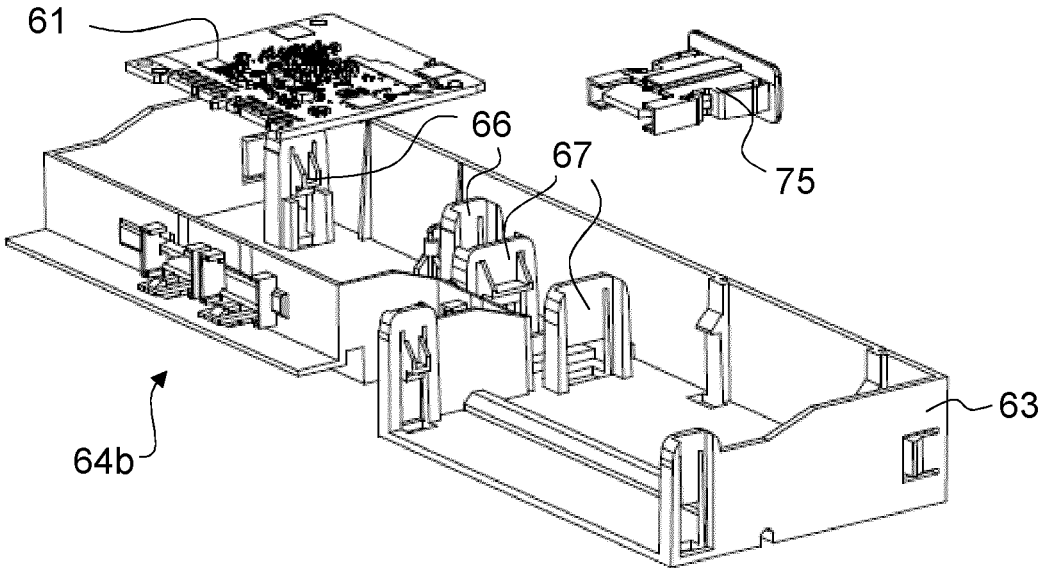

FIG. 7 illustrates a further assembly 64*a* that likewise comprises the transceiver unit 61. The further assembly 64*a* essentially differs from the assembly 64 that is illustrated in FIG. 5 by virtue of the fact that the further assembly 64*b* comprises in addition to the transceiver unit 61 a door opening sensor 75 that is arranged together with the transceiver unit 61 in the hollow space 18.

In the case of the embodiment that is illustrated in FIG. 7, the transceiver unit 61 is placed adjacent to the door opening sensor 75 on the frame 63. For the attachment of the transceiver unit 61 to the frame 63, said frame comprises for example latching hooks 66. For the attachment of the door opening sensor 75 to the frame 63, said frame comprises for example latching hooks 67. The further assembly 64*b* that is illustrated in FIG. 7 is illustrated without the cover 62 that is attached to the frame 63.

The assemblies 64*a*, 64*b* that are illustrated in FIGS. 6 and 7 are in particular arranged in the housing 2.

Figure 8:
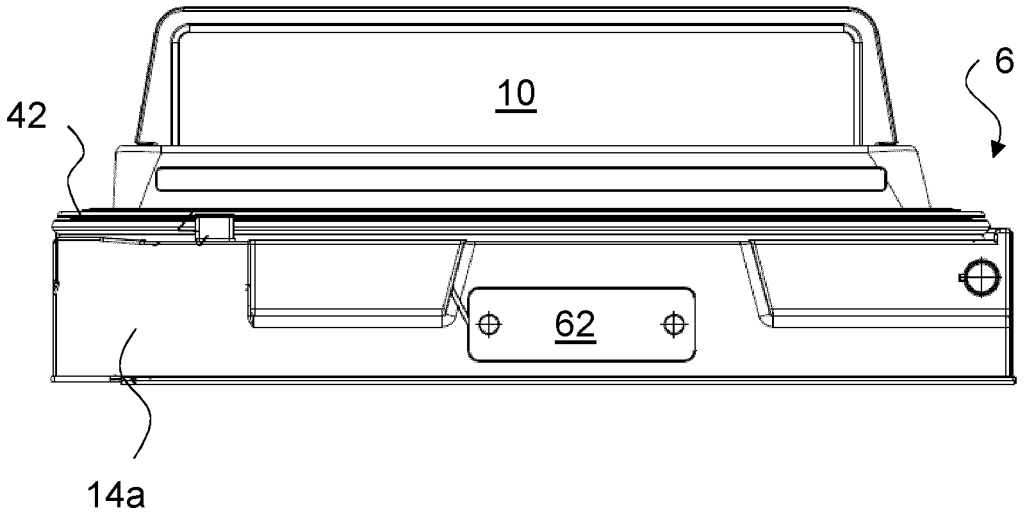
FIG. 8 shows a plan view of the door leaf with an installed transceiver unit.

The assembly 64 that is illustrated in FIG. 5 is preferably attached in the door leaf 6, in particular in the upper end face 14*a* of the door leaf 6 or in the front plate 8 of the drawer 7, in particular in the upper end face 16*a* of the front plate 8. This is illustrated in FIG. 2. A plan view of the door leaf 6, in which the cover 62 that is attached to the door leaf is shown, is illustrated in FIG. 8.

The frame 63 is made for example from plastic or from metal. The cover 62 is made for example from plastic.

Figure 9:
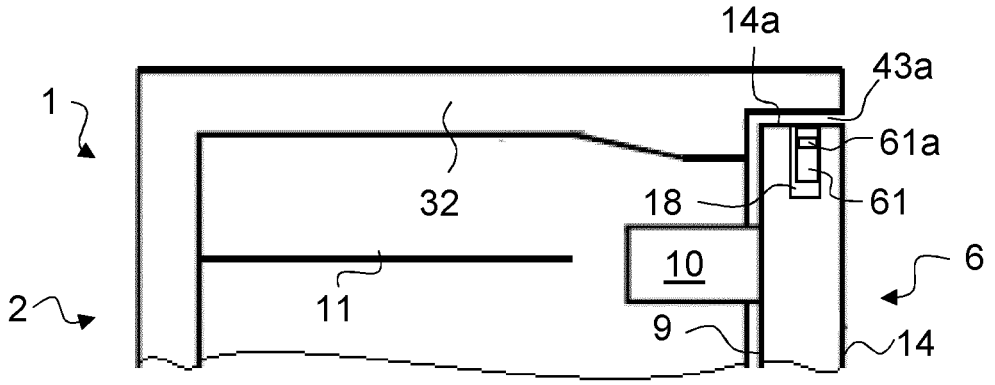
FIG. 9 shows an alternative embodiment of the household refrigeration appliance.

FIG. 9 illustrates the upper part of a second embodiment of the household refrigeration appliance 1 as a side view in a sectioned view. This embodiment differs from the embodiment that is illustrated in FIG. 1 by virtue of the fact that the end face of the upper horizontally running wall 32 overlaps in part the upper end face 14*a* of the closed door leaf 6 and together with the closed door leaf 6 forms a gap 43*a*. If the door leaf 6 now comprises the hollow space 18 and if the opening 19 is arranged in the upper end face 14*a* of the door leaf 6, then signals that are transmitted by the antenna 61*a* of the transceiver unit 61 or are received by the antenna 61*a* are able to pass through the gap 43*a* and through the electrically non-conductive cover 62.

Figure 10:
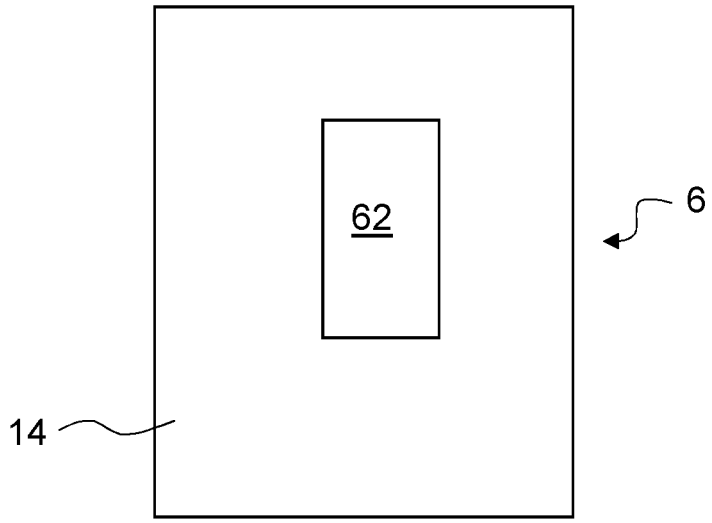
FIG. 10 shows a front view of the door leaf with an installed transceiver unit.
Figure 11:
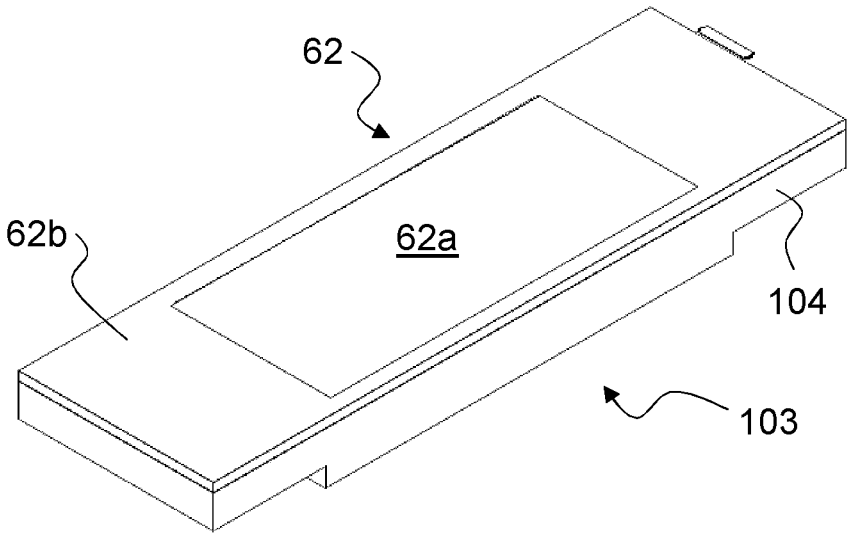
FIG. 11 shows an assembly that comprises the transceiver unit and a display apparatus in a perspective view.
Figure 12:
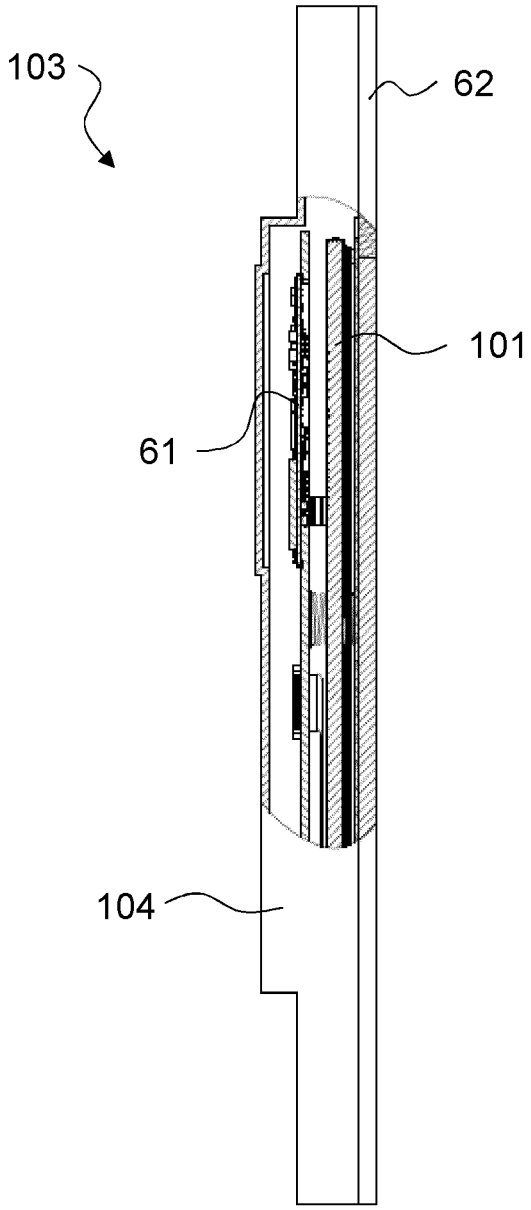
FIG. 12 shows the assembly of the FIG. 11 in a side view in an in part sectioned view, and FIG. 13, 14 show exploded views of the transceiver unit and of the display apparatus.

FIGS. 10 to 14 illustrate an embodiment of the household refrigeration appliance 1 in accordance with which the cover 62 is part of the outer side of the household refrigeration appliance 1, for example part of the outer side 39 of the housing 2 or preferably part of the outer side 14 of the door leaf 6 or part of the outer side 16 of the front plate 8 of the drawer 7. Consequently, the opening 19 is arranged in the outer side 39, 14, 16 of the housing 2, of the door leaf 6 or of the front plate 8. FIG. 10 illustrates as an example the outer side 14 of the door leaf 6 with the transceiver unit 61 that is arranged behind the cover 62 in the hollow space 18.

In the case of the present exemplary embodiment, the household refrigeration appliance 1 comprises a display apparatus 101 that is arranged together with the transceiver unit 61 in the hollow space 18. In particular, the transceiver unit 61 is arranged behind the display apparatus 101 and the display apparatus 101 is arranged behind the cover 62. The electrically non-conductive cover 62 is at least semi-transparent in particular made from glass with the result that information content that is displayed by the display apparatus 101 can be viewed through the at least semi-transparent, electrically non-conductive cover 62.

The transceiver unit 61 comprises for example a circuit board 61*b* on which the antenna and electronic components 61*c* of the transceiver unit 61 are arranged.

In the case of the present exemplary embodiment, the display apparatus 101 is designed in a planar manner and the transceiver 61 is attached to the rear side of the planar display apparatus 101.

In the case of the present exemplary embodiment, the transceiver 61 and the display apparatus 101 are arranged in a housing 104, which is made for example from plastic, and together with the housing 104 form an assembly 103. This assembly 103 is illustrated in a perspective view in FIG. 11 and as a side view in an in part sectioned view in FIG. 12.

Figure 13:
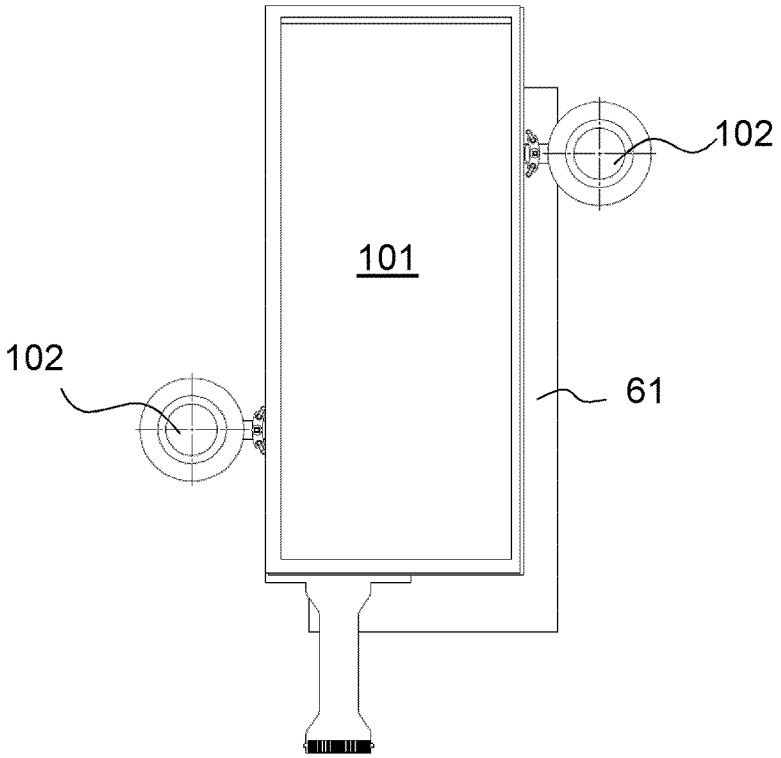
Figure 14:
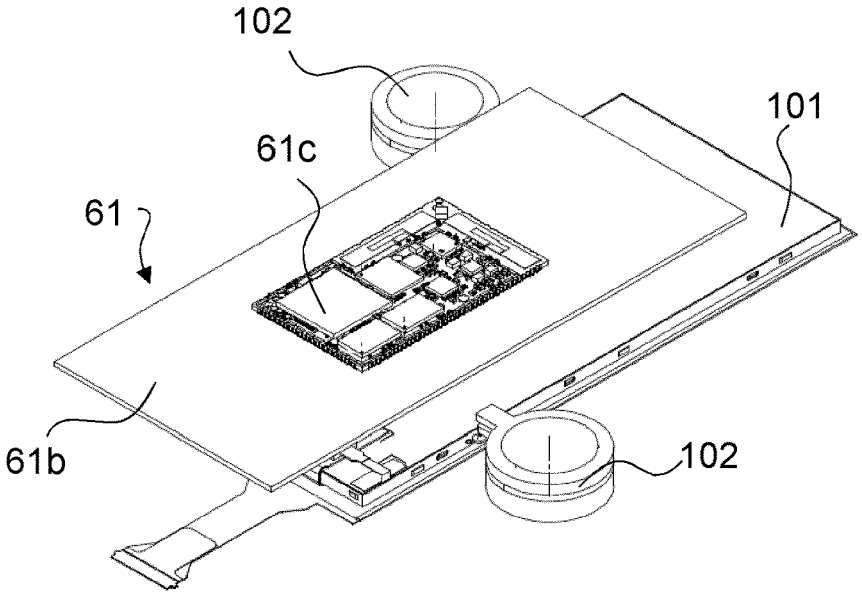

In the case of the present exemplary embodiment, the household refrigeration appliance 1 comprises two speakers 102 which are arranged behind the cover 62, in particular behind a largely opaque border region 62*b* of the cover 62. FIGS. 13 and 14 illustrate the transceiver unit 61, the display apparatus 101 and the speakers 102 in exploded views.

In the case of the present exemplary embodiment, the cover 62 comprises a transparent region 62*a*, through which the information content of the display apparatus 101 can be viewed, and the non-transparent frame 62*b* which covers the speakers 102.

The above described household refrigeration appliance 1 comprises the two interior spaces that can be cooled, of which the upper interior space can be closed by the door leaf 6 and the lower interior space can be closed by the drawer 7. Alternatively, it is also possible to provide that the household refrigeration appliance comprises two drawers 7 each having a front plate 8 with the result that, rather than by the door leaf 6, the upper interior space that can be cooled can be closed by a further drawer that has a front plate. The further drawer can consequently be pulled at least in part out of the upper interior space that can be cooled and the front plate of the closed further drawer closes the upper interior space that can be cooled. In particular, in this case the upper interior space that can be cooled does not comprise shelves 11 and also does not comprise the drawer 12.

LIST OF REFERENCE CHARACTERS

1 Household refrigeration appliance
2 Housing
3 Refrigeration apparatus
4 Refrigerator compartment
5 Freezer compartment
6 Door leaf
7 Drawer
8 Front plate
9 Inner side
10 Door rack
11 Shelf
12 Drawer
11 Container
14 Outer side
14*a* Upper end face
14*b* Lower end face
15 Inner side
16 Outer side
16*a* Upper end face
17 Gap
18 Hollow space
19 Opening
21 Hinge
31 Side walls
32 Upper horizontally running wall
33 Middle horizontally running wall
35, 36 Side
37 Inner sides
38 Side
39 Outer side
40 Upper frame
41 Housing opening
42 Door seal
43, 43*a* Gap
50 Lower frame
51 Housing opening
52 Seal
53 Base
61 Transceiver unit
61*a* Antenna
61*b* Circuit board
61*c* Electronic components
62 Cover
62*a* Transparent region
62*b* Border region
63 Frame
64, 64*a*, 64*b* Assembly
65 Electronic system
75 Door opening sensor
101 Display apparatus
102 Speaker
103 Assembly
104 Housing

The invention claimed is:

1. A household appliance, comprising:

a housing having a housing opening formed therein and delimiting an interior space being accessible via said housing opening, and a frame bordering said housing opening;

a door leaf mounted so as to be able to pivot relative to said housing and disposed so as to open and close said interior space, or a drawer being pullable at least in part out of said interior space and having a front plate that in a pushed-in state closes said interior space;

at least one transceiver unit having an antenna so as to receive and transmit signals in a wireless manner; and at least one electrically non-conductive cover;

said housing or said door leaf or said front plate of said drawer having a further opening formed therein; and said housing, said door leaf or said front plate of said drawer having a hollow space formed therein that is accessible via said further opening formed in said housing, in said door leaf or in said front plate and said at least one transceiver unit together with said antenna disposed within said hollow space, and said at least one electrically non- conductive cover completely covers said further opening;

wherein one of the following groups (1), (2), or (3) of limitations is present:

(1) said further opening to said hollow space is disposed in said frame of said housing, and said at least one electrically non-conductive cover completely covers said further opening and consequently is part of said frame; or (2) said further opening to said hollow space is disposed in an end face of said door leaf, and said at least one electrically non-conductive cover completely covers said further opening and is part of said end face of said door leaf; or (3) said further opening to said hollow space is disposed in an end face of said drawer, and said at least one electrically non-conductive cover completely covers said further opening and is part of said end face of said front plate; and wherein one of the following groups (a), (b), or (c) of limitations is present:

(a) wherein said housing has a horizontally running wall that contains said hollow space, wherein said door leaf or said front plate of said drawer overlaps said frame of said housing at least in a region of said further opening, wherein an inner side, which faces said interior space, of said door leaf when said door leaf is closed, or an inner side, which faces said interior space, of said front plate of said drawer when said drawer is closed is spaced at least in said region of said further opening from said frame such that said inner side of said door leaf or of said front plate of said drawer forms a gap at least in said region of said further opening, wherein the signals that are transmitted by said antenna of said at least one transceiver unit or are received by said antenna are able to pass through said gap and through said at least one electrically non-conductive cover; or (b) wherein said door leaf contains said hollow space, said further opening is disposed in an upward facing upper end face of said door leaf, wherein a component of the household appliance overlaps said upward facing upper end face of said door leaf when said door leaf is closed and is spaced from said upward facing upper end face of said door leaf when said door leaf is closed in such a manner that said upward facing upper end face of said door leaf when said door leaf is closed forms a gap with the component of the household refrigeration appliance, wherein the signals that are transmitted by said antenna of said at least one transceiver unit or are received by said antenna are able to pass through said gap and through said at least one electrically non-conductive cover; or (c) wherein said front plate of said drawer contains said hollow space, wherein said further opening is disposed in an upward facing upper end face of said front plate, wherein a component of the household appliance overlaps said upward facing upper end face of said front plate of said drawer when said drawer is closed and is spaced from said upward facing upper end face of said front plate of said drawer when said drawer is closed such that said upward facing upper end face of said front plate of said drawer forms a gap with the component of the household appliance, wherein the signals that are transmitted by said antenna of said at least one transceiver unit or are received by said antenna are able to pass through said gap and through said at least one electrically non-conductive cover.

2. The household appliance according to claim 1, wherein said housing, said door leaf and said front plate each have an outward facing outer skin that is manufactured from metal or containing metal.

3. The household appliance according to claim 2, wherein said outward facing outer skins extend as far as said frame of said housing and end faces of said door leaf and/or of said front plate of said drawer.

4. The household appliance according to claim 1, wherein:

the component of the household appliance is said horizontal running wall of said housing, wherein said housing with said horizontally running wall overlaps said upward facing upper end face of said door leaf, when said door leaf is closed, or overlaps said upward facing upper end face of said front plate of said drawer when said drawer is closed; or the component of the household appliance is a further door leaf that, when said further door leaf closed, is disposed above said door leaf when said door leaf is closed, and wherein a downward facing lower end face of said further door leaf, when closed, overlaps said upward facing upper end face of said door leaf when said door leaf is closed; or the component of the household appliance is a further drawer that, when closed, is disposed above said drawer when said drawer is closed, and wherein a downward facing end face of a front plate of said further drawer, when closed, overlaps said upward facing upper end face of said front plate of said drawer when said drawer is closed; or said interior space is a lower interior space and said housing of the household appliance delimits an upper interior space that is disposed above said lower interior space, wherein said drawer is allocated to said lower interior space and said door leaf is allocated to said upper interior space and the component of the household appliance is said door leaf, wherein when said door leaf is closed, said door leaf is disposed above said drawer when said drawer is closed, and wherein said downward facing lower end face of said door leaf, when closed, overlaps said upward facing upper end face of said front plate of said drawer when said drawer is closed.

5. The household appliance according to claim 1, wherein:

said door leaf contains said hollow space and said further opening is disposed in an outward facing outer side of said door leaf, and said at least one electrically non-conductive cover is part of an outer side of said door leaf; or said front plate of said drawer contains said hollow space and said further opening is disposed in an outward facing outer side of said front plate of said drawer, and said at least one electrically non-conductive cover is part of an outer side of said front plate of said drawer; or said housing contains said hollow space and said further opening is disposed in one of an outward facing outer side of said housing, and said at least one electrically non-conductive cover is part of said outward facing outer side of said housing.

6. The household appliance according to claim 1, further comprising a display apparatus that is disposed together with said at least one transceiver unit in said hollow space; and wherein said at least one electrically non-conductive cover is at least semi-transparent, and said display apparatus is disposed in said hollow space such that information content that is displayed by said display apparatus is viewable through said at least semi-transparent, electrically non-conductive cover.

7. The household appliance according to claim 6, wherein said at least one electrically non-conductive cover is made from glass.

8. The household appliance according to claim 1, wherein said at least one transceiver unit is pushed into said hollow space; and/or wherein said at least one transceiver unit is attached to said at least one electrically non-conductive cover; and/or further comprising an electronic control apparatus disposed in said hollow space and configured to activate at least one component of the household appliance.

9. The household appliance according to claim 1, wherein:

the household appliance is a household refrigeration appliance, and said housing is a thermally insulated housing, said door leaf is thermally insulated and said front plate is thermally insulated;

said interior space is an interior space that can be cooled and is provided so as to store food; and the household refrigeration appliance contains a refrigeration apparatus that is provided so as to cool said interior space that can be cooled.

10. The household appliance according to claim 9, wherein;

said door leaf has, on an inner side that faces said interior space that can be cooled, a circumferential door seal, wherein said circumferential seal lies against said frame of said housing, and wherein said frame and said inner side of said door leaf, when closed, form a gap; or said front plate of said drawer contains, on an inner side that faces said interior space that can be cooled, a circumferential seal, wherein said circumferential seal lies against said frame of said housing when said drawer is closed, and wherein said frame and said inner side of said front plate of said drawer, when closed, form a gap.

11. The household appliance according to claim 1, wherein:

said frame has a horizontally running wall with an end face, said hollow space is disposed in said end face of said horizontally running wall, said end face forming in part said frame of said housing; or said end face of said door leaf is an upward facing upper end face and said hollow space is disposed in said upward facing upper end face of said door leaf; or said end face of said drawer is an upward facing upper end face and said hollow space is disposed in said facing upper end face of said front plate of said drawer.

* * * * *